US011015777B1

(12) United States Patent
Wu

(10) Patent No.: US 11,015,777 B1
(45) Date of Patent: May 25, 2021

(54) MAGNETIC SUSPENSION SUPPORT STRUCTURE

(71) Applicant: AE TECHNOLOGIES CO., LTD., Guangdong (CN)

(72) Inventor: Wenfeng Wu, Guangdong (CN)

(73) Assignee: AE TECHNOLOGIES CO., LTD., Guangzhou (CN)

( * ) Notice: Subject to any disclaimer, the term of this patent is extended or adjusted under 35 U.S.C. 154(b) by 0 days.

(21) Appl. No.: 17/019,968

(22) Filed: Sep. 14, 2020

(30) Foreign Application Priority Data

Aug. 17, 2020 (CN) ..... 202021719947.5

(51) Int. Cl.

| | |
|---|---|
| ***F21S 10/04*** | (2006.01) |
| ***F21S 6/00*** | (2006.01) |
| ***F21W 121/00*** | (2006.01) |
| *F21S 9/02* | (2006.01) |

(52) U.S. Cl.
CPC ..... *F21S 10/046* (2013.01); *F21S 6/001* (2013.01); *F21S 9/02* (2013.01); *F21W 2121/00* (2013.01)

(58) Field of Classification Search
CPC ..... F21S 6/001; F21S 10/04; F21S 10/043; F21S 10/046; F21W 2121/00; F21V 33/0004; F21V 33/0012; F21V 33/0024; F21V 33/0028; F21V 33/0048; F21V 14/02; F21V 14/025; F21V 14/04; F21V 14/045; F21V 21/30; F21V 35/00; F21V 35/003; F21V 35/006
See application file for complete search history.

(56) References Cited

U.S. PATENT DOCUMENTS

| | | | | |
|---|---|---|---|---|
| 4,551,794 | A * | 11/1985 | Sandell | F21S 10/04 362/392 |
| 2006/0034100 | A1* | 2/2006 | Schnuckle | B44C 5/06 362/161 |
| 2007/0242259 | A1* | 10/2007 | Kawakami | F21K 9/23 356/25 |
| 2014/0211499 | A1* | 7/2014 | Fong | F21S 6/001 362/558 |
| 2014/0362592 | A1* | 12/2014 | Lee | F21L 4/08 362/386 |
| 2015/0292697 | A1* | 10/2015 | Lai | F21S 10/046 362/286 |
| 2016/0146414 | A1* | 5/2016 | Dong | F21S 6/001 362/232 |

(Continued)

*Primary Examiner* — Bryon T Gyllstrom
*Assistant Examiner* — James M Endo

(57) ABSTRACT

The disclosure relates to the field of support structures, and discloses a magnetic suspension support structure including a hollowed-out mounting base and a magnetic suspension assembly. The magnetic suspension assembly is located within the mounting base, and includes a first permanent magnet, a second permanent magnet, a suspension piece for mounting a display object, and a movable positioning piece for restricting turn-over of the suspension piece. The first permanent magnet is arranged on the suspension piece and located above the second permanent magnet. The second permanent magnet is arranged on the mounting base or the positioning piece. The first permanent magnet and the second permanent magnet repel each other to produce a support force acting on the suspension piece in a magnetic repelling direction. One end of the suspension piece protrudes from the mounting base.

21 Claims, 14 Drawing Sheets

(56) References Cited

U.S. PATENT DOCUMENTS

| | | | | |
|---|---|---|---|---|
| 2017/0122511 | A1* | 5/2017 | Ding | F21V 17/002 |
| 2017/0122512 | A1* | 5/2017 | Yuan | F21S 10/04 |
| 2018/0340678 | A1* | 11/2018 | Pan | F21S 10/046 |
| 2019/0338905 | A1* | 11/2019 | Cheung | F21S 10/046 |

* cited by examiner

MAGNETIC SUSPENSION SUPPORT STRUCTURE

CROSS REFERENCE TO RELATED APPLICATIONS

The present application claims the benefit of Chinese Patent Application No. 202021719947.5 filed on Aug. 17, 2020, the contents of which are incorporated herein by reference in their entirety.

TECHNICAL FIELD

The disclosure relates to the field of support structures, and in particular to a magnetic suspension support structure.

BACKGROUND

Electronic light-emitting devices have been widely used in fields such as home lighting, functional lighting and special-purpose lighting. With the development of high technology, candles are generally used for building a certain atmosphere in daily life rather than for space lighting. They are expected to be novel, ornamental, and functional with higher requirements on environmental friendliness, energy saving and reliability. In this case, electronic candles or lighting products that can stimulate a realistic flame by using electronic light-emitting devices have emerged.

Common electronic candles stimulate flashing and flickering effects of light that are still very different from those of a realistic flame. Some products are designed to swing so as to improve their simulation effects. In the design of a flame moving mechanism, swing through mechanical contact and suspension of weight is usually adopted, which also comes with poor stability, high power loss, etc. Mechanical contact and suspension of a weight pendulum bob may create friction and resistance, resulting in more power consumption. This goes against the requirements for environmental friendliness and energy saving, and may affect the service life of a battery of a product. Besides, the swing can only be two-dimensional motion under the effect of contact and suspension of the mechanism, and rotation of a flame cannot be achieved. Consequently, the flame stimulation effect is not realistic, and ornamental sides are limited.

SUMMARY

An objective of embodiments of the disclosure is to provide a magnetic suspension support structure that can effectively realize simulation of two-dimensional moving and free rotation of a realistic flame and achieve a more realistic, gentler moving effect of a realistic flame.

To achieve the above purpose, the embodiments of the disclosure provide a magnetic suspension support structure, including a hollowed-out mounting base and a magnetic suspension assembly;

the magnetic suspension assembly is located within the mounting base, and includes a first permanent magnet, a second permanent magnet, a suspension piece for mounting a display object, and a positioning piece for restricting turn-over of the suspension piece;

the first permanent magnet is arranged on the suspension piece and located above the second permanent magnet; the second permanent magnet is arranged on the mounting base or the positioning piece; the first permanent magnet and the second permanent magnet repel each other to produce a support force acting on the suspension piece in a magnetic repelling direction; and one end of the suspension piece protrudes from the mounting base.

Compared with the prior art, the magnetic suspension support structure, using the technical solution of the magnetic suspension assembly fitting the positioning piece, solves the problem of poor swinging effect due to the effect of contact and suspension of a mechanism in the prior art, effectively realizes simulation of moving and free rotation effects of a realistic flame, and achieves a more realistic, gentler moving effect of a realistic flame.

As an improvement to the above solution, the suspension piece includes a connecting pillar allowing the display object to be mounted thereon; an auxiliary limiting hole allowing the connecting pillar to protrude from the mounting base is formed in the mounting base; and the auxiliary limiting hole serves to restrict turn-over of the connecting pillar.

Further, the disengagement of the positioning piece from the positioning hole can be prevented under the combined action of position limitation by the connecting pillar and the auxiliary limiting hole and position limitation by the positioning piece and the positioning hole, allowing the suspension piece to swing stably.

As an improvement to the above solution, the positioning piece, in a rod shape, is vertically and fixedly arranged at the bottom of the mounting base; the second permanent magnet is arranged on the positioning piece; a positioning hole is formed in the suspension piece and improvements larger cross-sectional area than the positioning piece; and when a weight of the suspension piece and the support force are balanced, one end of the positioning piece extends into the positioning hole to restrict turn-over of the whole suspension piece.

Further, the suspension piece can be movably supported by magnetic suspension under the combined action of the support force and movement restriction by the positioning piece. Ideally, since the suspension piece is axially symmetric as a whole under uniform stress, the vertically upward support force produced by the first permanent magnet and the second permanent magnet and the weight of the suspension piece will be balanced, and in this case, the suspension piece will be suspended in the mounting base, providing magnetic suspension support.

As an improvement to the above solution, the positioning hole includes a limiting portion close to an opening of the positioning hole and a travel portion located within the hole to allow upward and downward displacement of the suspension piece.

Further, when the suspension piece is acted upon by a vertically upward external force, the support force and the magnetic force will be unbalanced, resulting in vertically fluctuating of the display object along with the suspension piece under the impact of kinetic energy change. The suspension piece may stop fluctuating after the support force and the magnetic force are rebalanced. Thus, a superior swinging effect can be achieved.

As an improvement to the above solution, the positioning piece is horizontally fixedly arranged on an inner wall of the mounting base, with a positioning hole being formed in the positioning piece; and the suspension piece is in a rod shape and movably extends through the positioning hole.

Further, the suspension piece can be movably supported by magnetic suspension under the combined action of the support force and movement restriction by the positioning piece, providing magnetic suspension support.

As an improvement to the above solution, the suspension piece includes a balance portion for improving overall stability of the suspension piece, and the first permanent magnet is arranged on the balance portion.

Further, the stability of swinging of the suspension piece can be further improved by providing a balance portion.

As an improvement to the above solution, both of the first permanent magnet and the second permanent magnet are annular.

Further, the ring-shaped first permanent magnet cooperates with the axisymmetrically arranged suspension piece, which can further optimize the overall force balance of the suspension piece, and indirectly improve the stability of swinging of the suspension piece.

As an improvement to the above solution, the first permanent magnet is coaxial and collinear with the suspension piece.

As an improvement to the above solution, a balancing weight is arranged on the suspension piece.

As an improvement to the above solution, with the balancing weight to increase the overall weight of the suspension piece, the stability of swinging of the suspension piece can be further improved.

As an improvement to the above solution, the balancing weight has a trapezoidal, rectangular or semicircular cross section.

As an improvement to the above solution, the balance portion is in a shape of a hood with a downward opening.

The embodiments of the utility mode further provide a light source module, including a light cover in a flame shape having an outer flame cover body and an inner flame cavity; and a light source element is arranged in the inner flame cavity.

Compared with the prior art, the outer flame cover body and the inner flame cavity allow light rays emitted by the light source element to shine therethrough to different extents, achieving the effect of simulate the inner and outer cones of a realistic flame and rendering the glowing effect of the device more realistic.

As an improvement to the above solution, the outer flame cover body is cone-shaped or drop-shaped.

The embodiments of the utility mode further provide a magnetically suspended swinging electronic light-emitting guide device capable of simulating a realistic flame, including the magnetic suspension support structure in the above solution, and further a light source module arranged on the suspension piece, and a driving assembly that provides an external force to drive the suspension piece to swing.

Compared with the prior art, a magnetically suspended swinging electronic light-emitting device is obtained by combining a light-emitting module with the magnetic suspension support structure in the above solution, where the magnetic suspension support structure solves the problem of poor swinging effect due to the effect of contact and suspension of a mechanism in the prior art. Moreover, a driving assembly can apply an external force to the magnetic suspension support structure to drive a display object to swing, thereby effectively realizing simulation of moving and free rotation of a realistic flame and achieving a more realistic, gentler moving effect of a realistic flame.

As an improvement to the above solution, the device further includes a power module that is electrically connected to the light source module and the driving assembly.

Further, with the power module to supply power, passive power feeding by an external power source is avoided, and the convenience of use of the device is improved.

As an improvement to the above solution, the power module is in contactless power-feeding connection with the light source module.

Further, the mounting of the light source element may generally involve wiring arrangement, and there may be a problem of interference with the swinging of the suspension piece. The problem of interference of wiring can be solved by means of the contactless power-feeding connection.

As an improvement to the above solution, the device further includes a control module for controlling a brightness of the light source module, where a power terminal of the control module is electrically connected to the power module; and a control terminal of the control module is electrically connected to the light source module and the driving assembly.

As an improvement to the above solution, the driving assembly is a magnetic driving assembly.

The magnetic driving assembly includes a coil arranged on the mounting base; and the control terminal of the control module is electrically connected to the coil.

Further, a magnetic force affecting the first permanent magnet may be changed by regularly varying power supply time of the coil in unit time, causing the suspension piece to tilt, swing or rotate due to the change of the force acting thereon in the horizontal direction and driving the suspension piece in a magnetic suspension equilibrium state and finally the light source module to swing. As a result, a gentle swinging effect based on the magnetic suspension support structure can be achieved, so that the swinging effect of the light source module can be very close to the moving effect of a realistic flame.

As an improvement to the above solution, the driving assembly is a wind power driving assembly.

The wind power driving assembly includes fan blades and a motor for driving the fan blades to rotate; the motor is arranged on the mounting base; the suspension piece is located in a direction of air blown out by the fan blades; and the control terminal of the control module is electrically connected to the motor.

As an improvement to the above solution, the driving assembly is a telescopic shaft driving assembly.

The telescopic shaft driving assembly includes a telescopic shaft and a cylinder, and the cylinder is arranged on the mounting base; the suspension piece is located in a moving travel of the telescopic shaft; and the control terminal of the control module is electrically connected to the cylinder.

As an improvement to the above solution, the light source module includes a light cover in a flame shape having an outer flame cover body and an inner flame cavity; and a light source element is arranged in the inner flame cavity.

As an improvement to the above solution, the outer flame cover body is cone-shaped or drop-shaped.

As an improvement to the above solution, the device further includes a housing disposed to cover the light source module, the magnetic suspension support structure and the power module.

Further, the housing covering the components serves to protect the components therein.

As an improvement to the above solution, the housing is in a shape of a pillar candle.

Further, the device not only has a glowing effect highly similar to that of a realistic flame, but also simulates a realistic candle in appearance, thus allowing for a further improvement on the overall ornamental effect of the device.

An embodiment of the disclosure further provides a magnetically suspended swinging electronic light-emitting guide device capable of simulating a realistic flame, including the magnetic suspension support structure in the above solution, and further a light source module arranged on the suspension piece, and a driving assembly that provides an external force to drive the suspension piece to swing;

where the light source module includes a light source element, a light guide bar and a flame-shaped light cover;

the light source element is arranged at an end, extending into the positioning hole, of the positioning piece;

the light guide bar extends through and is fixedly arranged inside the connecting pillar to be coaxial with the connecting pillar;

the light cover is arranged at an end of the connecting pillar, and one end of the light guide bar is located at the bottom of the light cover.

Compared with the prior art, the magnetically suspended swinging electronic light-emitting guide device is obtained by combining a light-emitting module with the magnetic suspension support structure in the above solution, where the magnetic suspension support structure solves the problem of poor swinging effect due to the effect of contact and suspension of a mechanism in the prior art. Moreover, the driving assembly can apply an external force to the magnetic suspension support structure to drive a display object to swing, thereby effectively realizing simulation of moving and free rotation of a realistic flame and achieving a more realistic, gentler moving effect of a realistic flame.

As an improvement to the above solution, the device further includes a power module that is electrically connected to the light source module and the driving assembly.

As an improvement to the above solution, the device further includes a control module for controlling a brightness of the light source module, where a power terminal of the control module is electrically connected to the power module; and a control terminal of the control module is electrically connected to the light source module and the driving assembly.

As an improvement to the above solution, the light cover includes an outer flame cover body and an inner flame cavity; and one end of the light guide bar is located in the inner flame cavity.

As an improvement to the above solution, the outer flame cover body is cone-shaped or drop-shaped.

As an improvement to the above solution, the suspension piece includes a balance portion for improving overall stability of the suspension piece, and the first permanent magnet is arranged on the balance portion.

As an improvement to the above solution, both of the first permanent magnet and the second permanent magnet are annular.

As an improvement to the above solution, the first permanent magnet is coaxial and collinear with the suspension piece.

As an improvement to the above solution, the balance portion is in a shape of a hood with a downward opening.

REFERENCE NUMERALS

10—mounting base, 101—auxiliary limiting hole;

20—magnetic suspension assembly, 201—first permanent magnet, 202—second permanent magnet, 203—suspension piece, 2031—positioning hole, 204—positioning piece, 205—connecting pillar, 206—balance portion, 207—balancing weight;

30—light source module, 301—outer flame cover body, 302—inner flame cavity, 303—light source element, 304—light guide bar;

40—driving assembly, 401—coil;

50—power module;

60—control module; and

70—housing.

DETAILED DESCRIPTION

The technical solutions in the embodiments of the disclosure will be described below clearly and completely with reference to the accompanying drawings in the embodiments of the disclosure. Apparently, the embodiments described below are merely part of rather than all embodiments of the disclosure. All other embodiments obtained by a person of ordinary skill in the art based on the embodiments of the disclosure without creative efforts shall fall within the protection scope of the disclosure.

Embodiment 1

Figure 1:
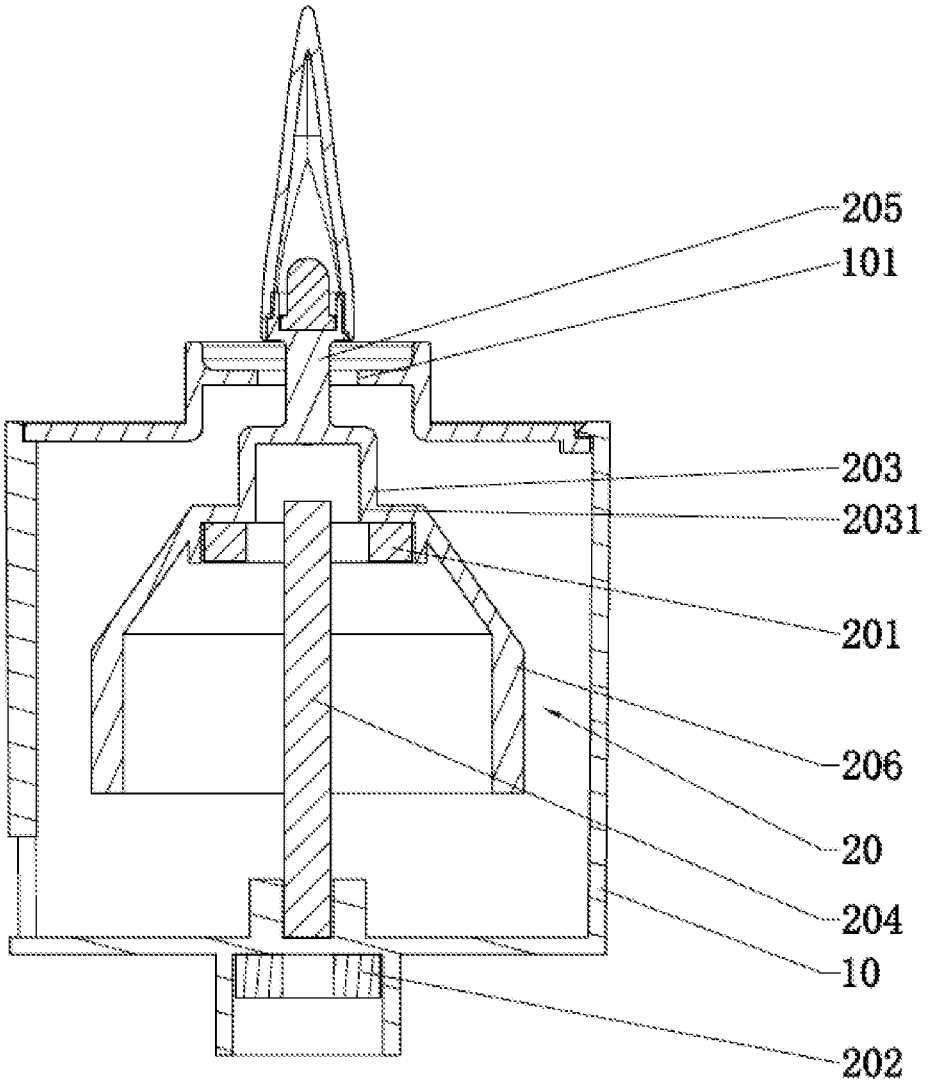
FIG. 1 is a schematic diagram illustrating a specific structure according to Embodiment 1 of the disclosure.
Figure 2:
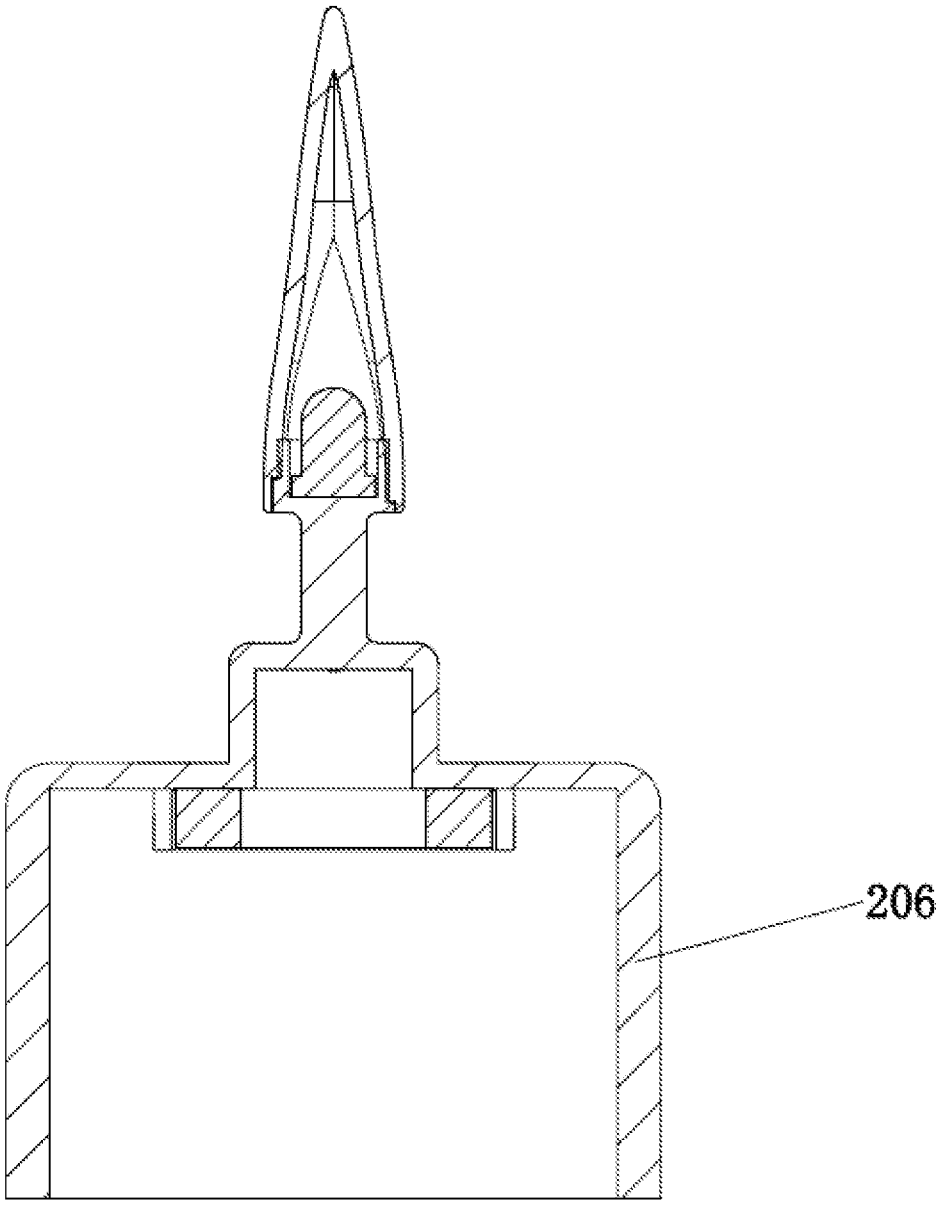
FIG. 2 is a structural schematic diagram of a rectangular balance portion according to Embodiment 1 of the disclosure.
Figure 3:
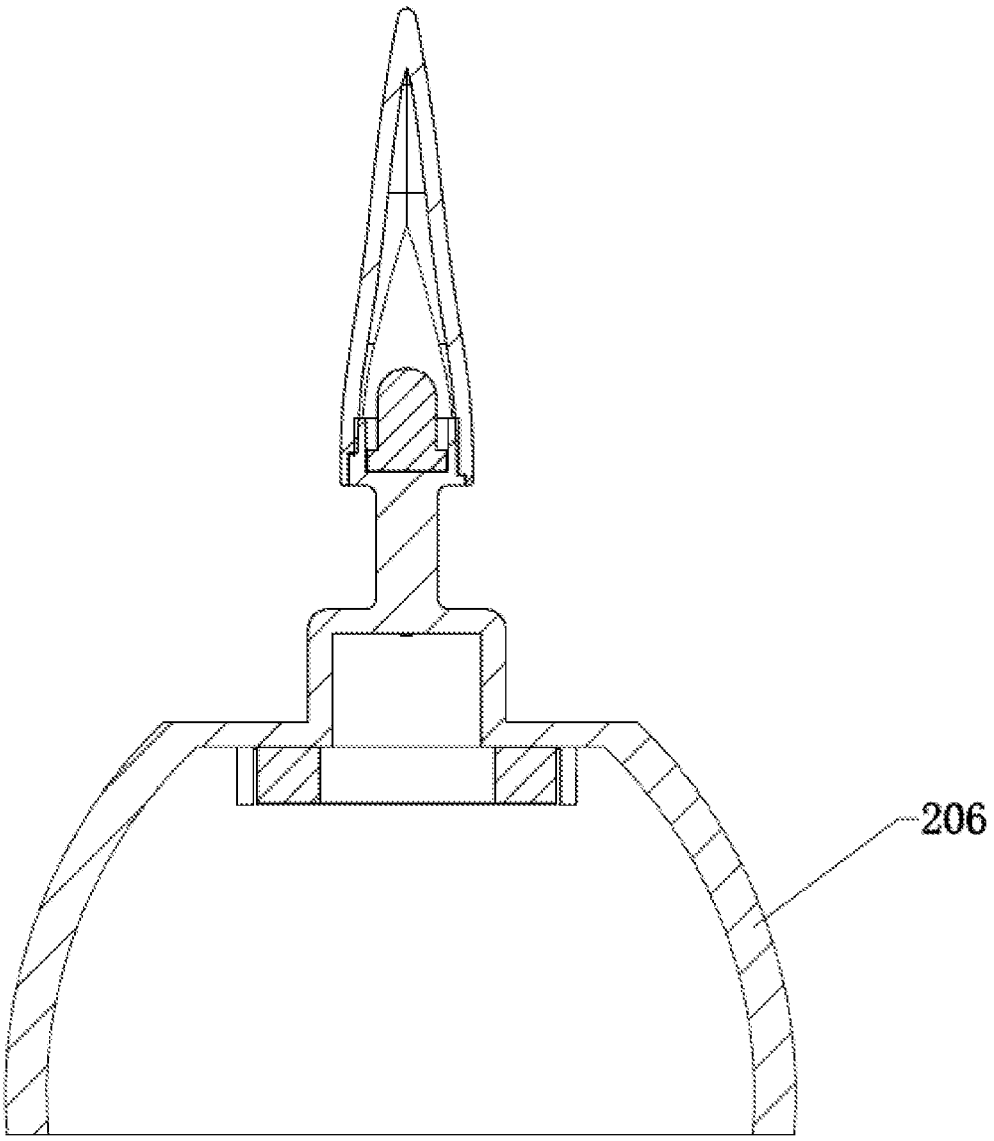
FIG. 3 is a structural schematic diagram of an arc-shaped balance portion according to Embodiment 1 of the disclosure.
Figure 4:
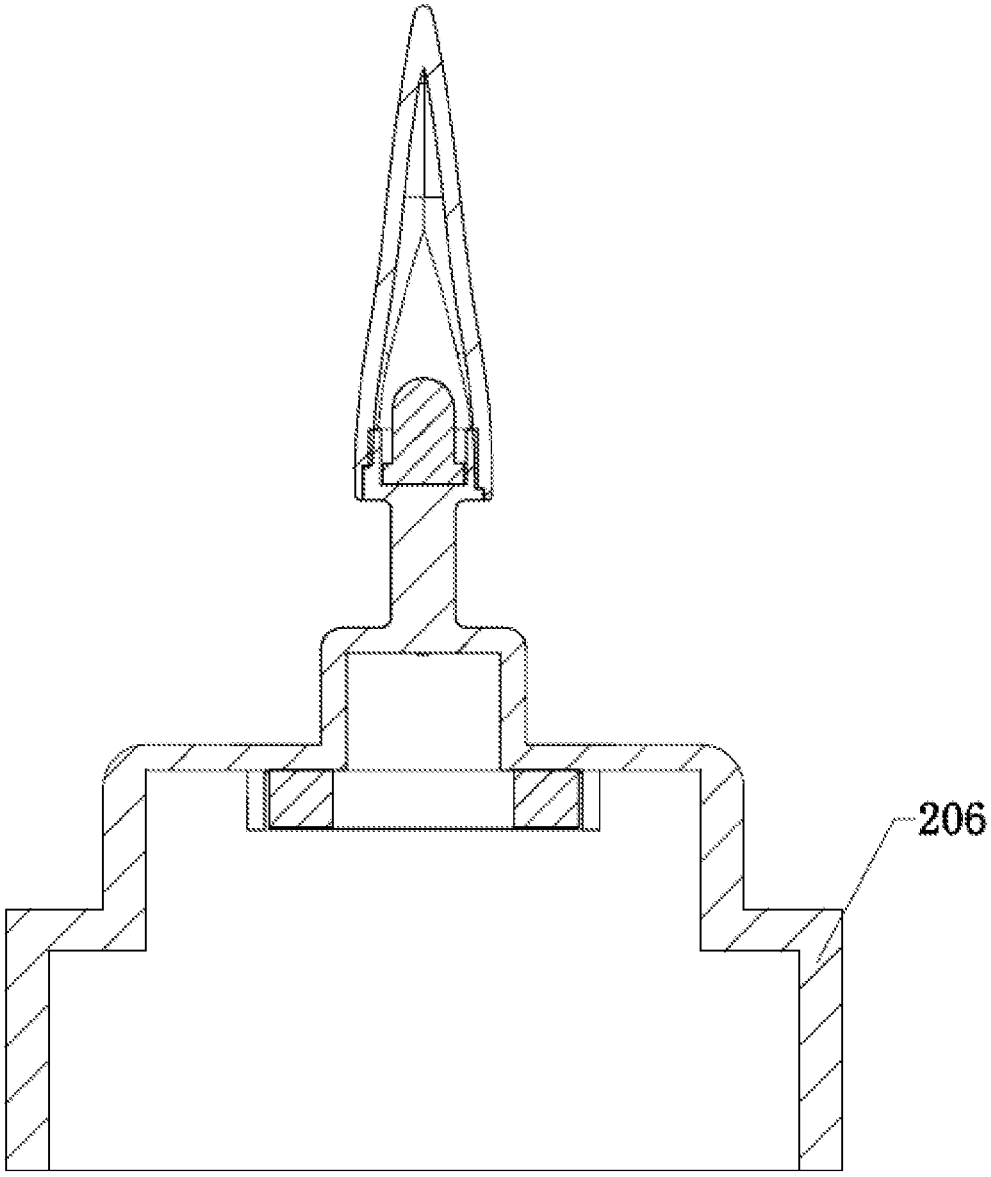
FIG. 4 is a structural schematic diagram of a delta-shaped balance portion according to Embodiment 1 of the disclosure.
Figure 5:
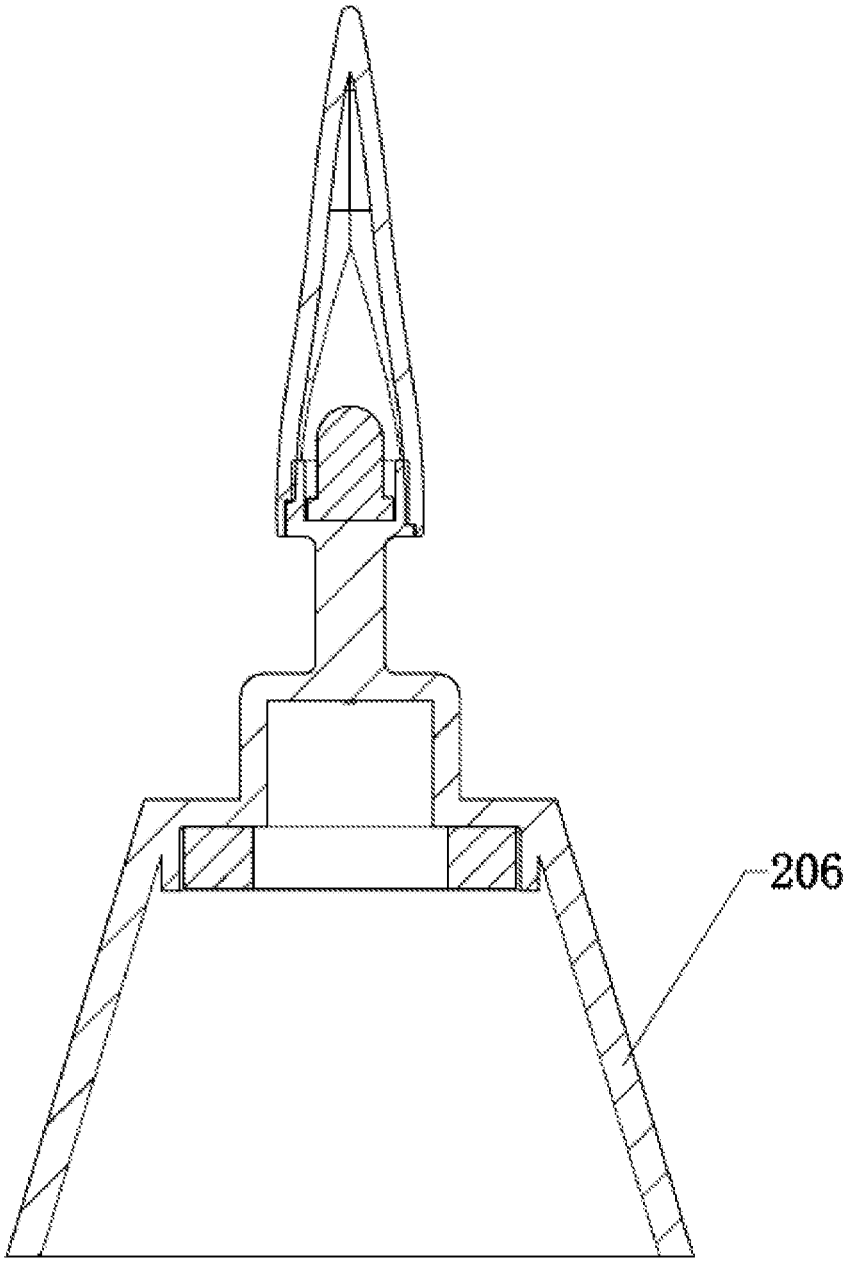
FIG. 5 is a structural schematic diagram of a cone-shaped balance portion according to Embodiment 1 of the disclosure.

Referring to FIG. 1, a magnetic suspension support structure includes a hollowed-out mounting base 10 and a magnetic suspension assembly 20.

The magnetic suspension assembly 20 is located within the mounting base 10, and includes a first permanent magnet 201, a second permanent magnet 202, a suspension piece 203 for mounting a display object, and a positioning piece 204 for restricting turn-over of the suspension piece 203.

In this embodiment, the suspension piece 203 has an axially symmetric shape structure, with the first permanent magnet 201 being secured to the suspension piece 203 and located above the second permanent magnet 202. The second permanent magnet 202 may be secured to the mounting base 10 or the positioning piece 204. In this embodiment, the second permanent magnet 202 is secured to the bottom of the mounting base 10. The first permanent magnet 201 and the second permanent magnet 202 repel each other to produce a support force acting vertically upwards on the suspension piece 203 in a magnetic repelling direction. One end of the suspension piece 203 protrudes from the mounting base 10.

Further, as shown in the figure, the second permanent magnet 202 may only need to be fixedly arranged below the first permanent magnet 201 to realize magnetic repelling. Therefore, the second permanent magnet 202 may be fixed to the mounting base 10 or the positioning piece 204. This embodiment is described in detail with the second permanent magnet 202 being fixed to the bottom of the mounting base 10.

The positioning piece 204, in a rod shape, is vertically secured to the bottom of the mounting base 10. A positioning hole 2031 is formed in the suspension piece 203 and has a larger cross-sectional area than the positioning piece 204. When the weight of the suspension piece 203 and the support force are balanced, one end of the positioning piece 204 extends into the positioning hole 2031 to restrict turn-over of the whole suspension piece 203.

Therefore, the suspension piece 203 can be movably supported by magnetic suspension under the combined action of the support force and movement restriction by the positioning piece 204. Ideally, since the suspension piece 203 is axially symmetric as a whole under uniform stress, the vertically upward support force produced by the first permanent magnet 201 and the second permanent magnet 202 and the weight of the suspension piece 203 will be balanced, and in this case, the suspension piece 203 will be suspended in the mounting base 10.

However, this case is merely based on the force condition involving magnetic force and weight. In practical use, the suspension piece 203 may often tilt laterally due to a horizontal external force acting thereon. In this case, the positioning hole 2031 and the positioning piece 204 serve to restrict movement. Since the positioning hole 2031 has the larger cross-sectional area than the positioning piece 204 and one end of the positioning piece 204 extends into the positioning hole 2031 when the weight of the suspension piece 203 and the support force are balanced, a wall of the positioning hole 2031 will approach the positioning piece 204 gradually until it abuts against the positioning piece 204 when the suspension piece 203 tilts, thus achieving a movement restriction effect on the suspension piece 203. Therefore, the suspension piece 203, when being acted upon by an instantaneous external force once, will drive the display object to swing, causing the positioning hole 2031 in the suspension piece 203 to have multiple collisions with the positioning piece 204. Counter-acting forces in opposite directions will be produced simultaneously by each collision, and will decrease progressively until the suspension piece 203 stops swinging, which is representative of the end of the swinging process. The external force may be wind, collision by a foreign object, or a magnetic field force acting on the first permanent magnet 201, which is not limited here.

It needs to be noted that the movement of the suspension piece 203 is restricted within a certain range which is related to a difference in cross-sectional area between the positioning hole 2031 and the positioning piece 204. A bigger difference in cross-sectional area means a broader range of horizontal movement of the suspension piece 203 while a smaller difference means a narrower range. In this way, the problem of limiting the suspension piece 203 horizontally is solved perfectly. Excellent suspension support can be provided for the suspension piece 203 which is suspended, and a gentler swinging effect of the display object can be achieved. When the display object is an electronic flame-simulating light source, an extremely realistic moving flame effect can be achieved.

With the cooperation between the positioning piece 204 and the positioning hole 2031, the suspension piece 203 can be well limited horizontally. To allow for a broad range of horizontal movement of the suspension piece 203, it will result in a big difference in cross-sectional area between the positioning hole 2031 and the positioning piece 204, which will cause a stability problem. In case of a too large external force acting on the suspension piece 203, the positioning piece 204 will be disengaged from the positioning hole 2031 of the suspension piece 203. To solve the stability problem, a length of a portion, extending into the positioning hole 2031, of the positioning piece 204 may be increased.

Preferably, to further solve the stability problem of swinging of the suspension piece 203, the suspension piece 203 includes a connecting pillar 205 allowing the display object to be mounted thereon in this embodiment, and an auxiliary limiting hole 101 allowing the connecting pillar 205 to protrude from the mounting base 10 is formed in the mounting base 10. Accordingly, the connecting pillar 205 movably extends through the auxiliary limiting hole 101.

The disengagement of the positioning piece 204 from the positioning hole 2031 can be prevented under the combined action of position limitation by the connecting pillar 205 and the auxiliary limiting hole 101 and position limitation by the positioning piece 204 and the positioning hole 2031, allowing the suspension piece 203 to swing stably.

Preferably, to achieve a more obvious vertical fluctuating effect of the suspension piece 203, the positioning hole 2031 includes a limiting portion close to the opening and a travel portion located within the hole to allow the suspension piece 203 to fluctuate elastically. The vertically upward support force produced by the first permanent magnet 201 and the second permanent magnet 202 and the weight of the suspension piece 203 will be balanced when the positioning piece 204 is located at the limiting portion.

When the suspension piece 203 is acted upon by a vertically upward external force, the support force and the magnetic force will be unbalanced, resulting in vertically fluctuating of the display object along with the suspension piece 203 under the impact of kinetic energy change. The suspension piece 203 may stop fluctuating after the support force and the magnetic force are rebalanced. Thus, a superior swinging effect can be achieved.

Preferably, the suspension piece 203 includes a balance portion 206 for improving the overall stability of the suspension piece 203, and the first permanent magnet 201 is fixed to the balance portion 206. In this embodiment, the balance portion 206 is in a shape of a hood with a downward opening.

Preferably, as shown in FIG. 2 to FIG. 5,

The balance portion 206 may have a rectangular, arc-shaped, delta-shaped or cone-shaped cross section. In this embodiment, the balance portion 206 has a rectangular cross section.

Figure 6:
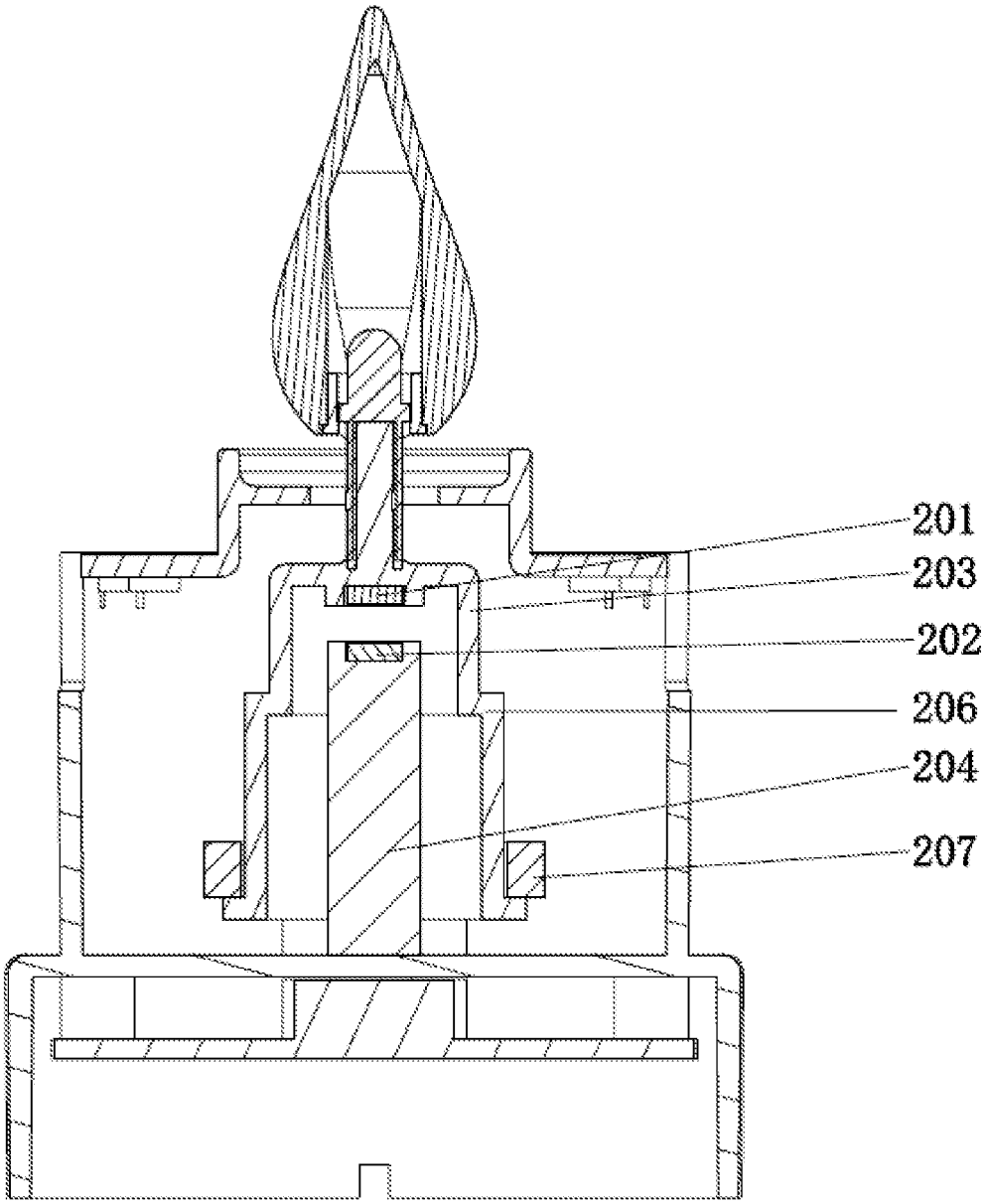
FIG. 6 is a schematic diagram illustrating a specific structure of a balancing weight according to Embodiment 1 of the disclosure.

As an improvement to the above solution, as shown in FIG. 6, the second permanent magnet 202 is fixed to one end of the positioning piece 204 and located under the first permanent magnet 201 according to this solution. A balancing weight 207 is fixed to the balance portion 206 of the suspension piece 203. With the balancing weight 207 to increase the overall weight of the suspension piece 203, the stability of swinging of the suspension piece 203 can be further improved.

Embodiment 2

Figure 7:
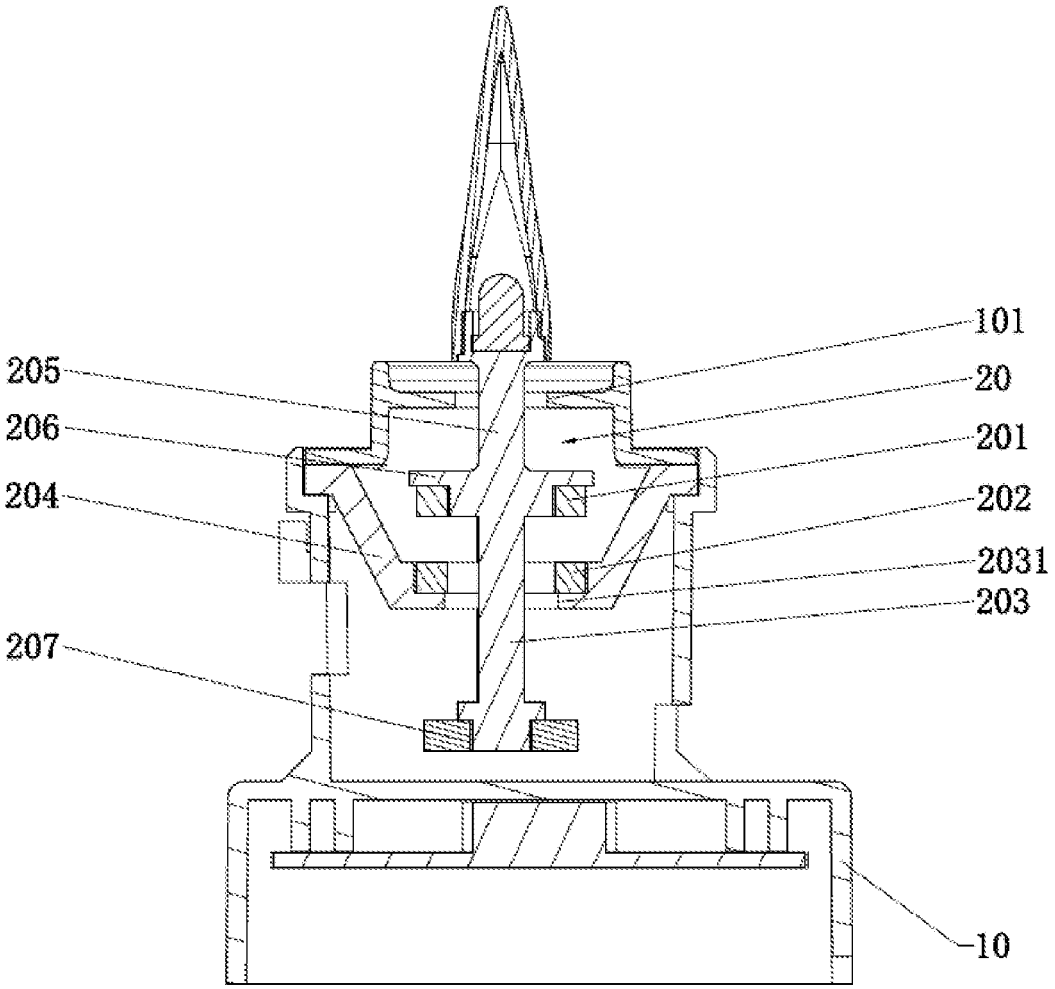
FIG. 7 is a schematic diagram illustrating a specific structure according to Embodiment 2 of the disclosure.

Referring to FIG. 7, a magnetic suspension support structure includes a hollowed-out mounting base 10 and a magnetic suspension assembly 20.

The magnetic suspension assembly 20 is located within the mounting base 10, and includes a first permanent magnet 201, a second permanent magnet 202, a suspension piece 203 for mounting a display object, and a positioning piece 204 for restricting turn-over of the suspension piece 203.

In this embodiment, the suspension piece 203 has an axially symmetric shape structure, with the first permanent magnet 201 being fixed to the suspension piece 203 and located above the second permanent magnet 202. The second permanent magnet 202 may be fixed to the mounting base 10 or the positioning piece 204. In this embodiment, the second permanent magnet 202 is fixed to the positioning piece 204. The first permanent magnet 201 and the second permanent magnet 202 repel each other to produce a support force acting vertically upwards on the suspension piece 203 in a magnetic repelling direction. One end of the suspension piece 203 protrudes from the mounting base 10.

Further, the second permanent magnet 202 may only need to be fixedly arranged below the first permanent magnet 201 to realize magnetic repelling. Therefore, the second permanent magnet 202 may be secured to the mounting base 10 or the positioning piece 204. This embodiment is described in detail with the second permanent magnet 202 being secured to the positioning piece 204.

In this embodiment, the positioning piece 204 is horizontally secured to an inner wall of the mounting base 10, with a positioning hole 2031 being formed in the positioning piece 204. The suspension piece 203 is in a shape of a pillar and movably extends through the positioning hole 2031.

Therefore, the suspension piece 203 can be movably supported by magnetic suspension under the combined action of the support force and movement restriction by the positioning piece 204. Ideally, since the suspension piece 203 is axially symmetric as a whole under uniform stress, the vertically upward support force produced by the first permanent magnet 201 and the second permanent magnet 202 and the weight of the suspension piece 203 will be balanced, and in this case, the suspension piece 203 will be suspended in the mounting base 10.

However, this case is merely based on the force condition involving magnetic force and weight. In practical use, the suspension piece 203 may often tilt laterally due to a horizontal external force acting thereon. In this case, the positioning piece 204 serves to restrict movement. Since the positioning hole 2031 has a larger cross-sectional area than the suspension piece 203, the suspension piece 203 will approach a wall of the positioning hole 2031 gradually until it abuts against the positioning hole 2031, thus achieving a movement restriction effect on the suspension piece 203. Therefore, the suspension piece 203, when being acted upon by an instantaneous external force once, will drive the display object to swing, causing the suspension piece 203 to have multiple collisions with the positioning hole 2031. Counter-acting forces in opposite directions will be produced simultaneously by each collision, and will decrease progressively until the suspension piece 203 stops swinging, which is representative of the end of the swinging process. The external force may be wind, collision by a foreign object, or a magnetic field force acting on the first permanent magnet 201, which is not limited here.

It needs to be noted that the movement of the suspension piece 203 is restricted within a certain range which is related to a difference in cross-sectional area between the positioning hole 2031 and the suspension piece 203. A bigger difference in cross-sectional area means a broader range of horizontal movement of the suspension piece 203 while a smaller difference means a narrower range. In this way, the problem of limiting the suspension piece 203 horizontally is solved perfectly, and excellent suspension support can be provided for the suspension piece 203 which is suspended.

With the cooperation between the positioning piece 204 and the positioning hole 2031, the suspension piece 203 can be well limited in horizontal position. To allow for a broad range of horizontal movement of the suspension piece 203, it will result in a big difference in cross-sectional area between the positioning hole 2031 and the positioning piece 204, which will cause a stability problem. In case of a too large external force acting on the suspension piece 203, the suspension piece 203 will swing violently.

To further solve the stability problem of swinging of the suspension piece 203, the suspension piece 203 includes a connecting pillar 205 allowing the display object to be mounted thereon in this embodiment, and an auxiliary limiting hole 101 allowing the connecting pillar 205 to protrude from the mounting base 10 is formed in the mounting base 10. Accordingly, the connecting pillar 205 movably extends through the auxiliary limiting hole 101.

Violent swinging of the suspension piece 203 can be prevented under the combined action of position limitation by the connecting pillar 205 and the auxiliary limiting hole 101 and position limitation by the positioning piece 204 and the positioning hole 2031, allowing the suspension piece 203 to swing stably. A gentler swinging effect of the display object can be achieved. When the display object is an electronic flame-simulating light source, a base part of the light source can be stabilized with a locating effect of the connecting pillar 205 and the auxiliary limiting hole 101, thus achieving an extremely realistic moving flame effect.

Preferably, the suspension piece 203 includes a balance portion 206 for improving the overall stability of the suspension piece 203, and the first permanent magnet 201 is fixed to the balance portion 206. In this embodiment, the balance portion 206 is disposed horizontally to extend outwards with the suspension piece 203 as a center to improve the overall stability of the suspension piece 203.

As an improvement to the above solution, a balancing weight 207 is fixed to the bottom of the suspension piece 203. With the balancing weight 207 to increase the overall weight of the suspension piece 203, the stability of swinging of the suspension piece 203 can be further improved.

Figure 8:
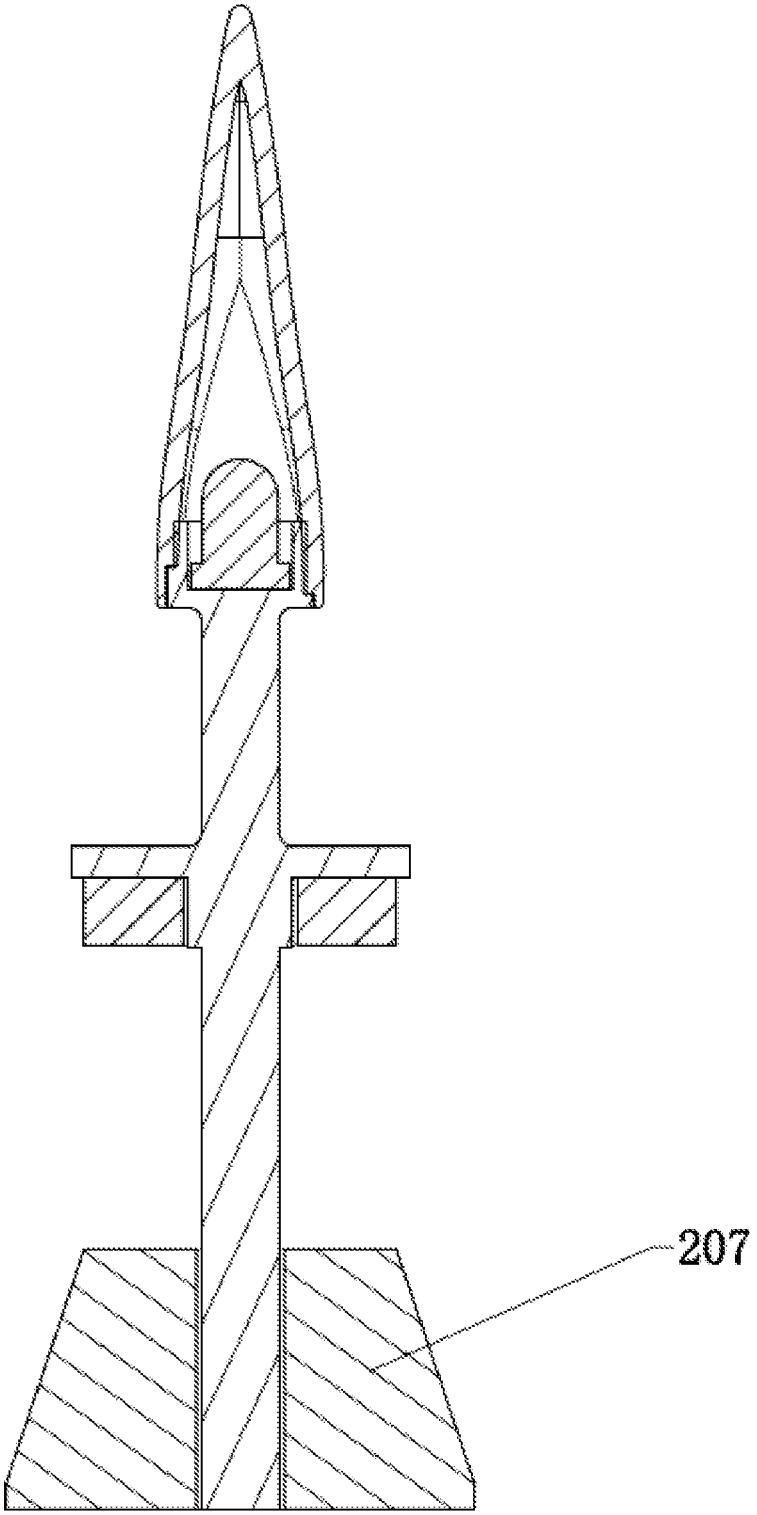
FIG. 8 is a schematic diagram illustrating a specific structure of a trapezoidal balancing weight according to Embodiment 2 of the disclosure.
Figure 9:
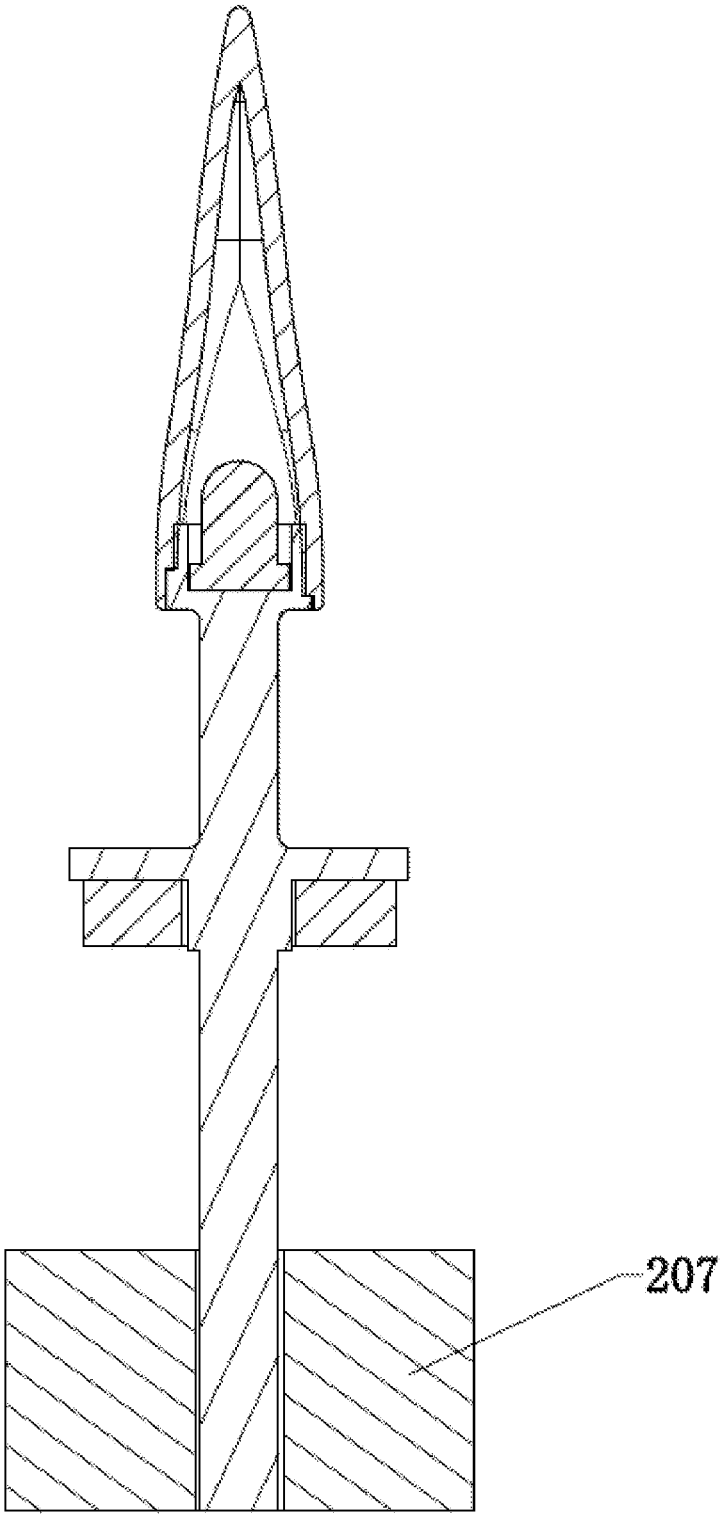
FIG. 9 is a schematic diagram illustrating a specific structure of a rectangular balancing weight according to Embodiment 2 of the disclosure.
Figure 10:
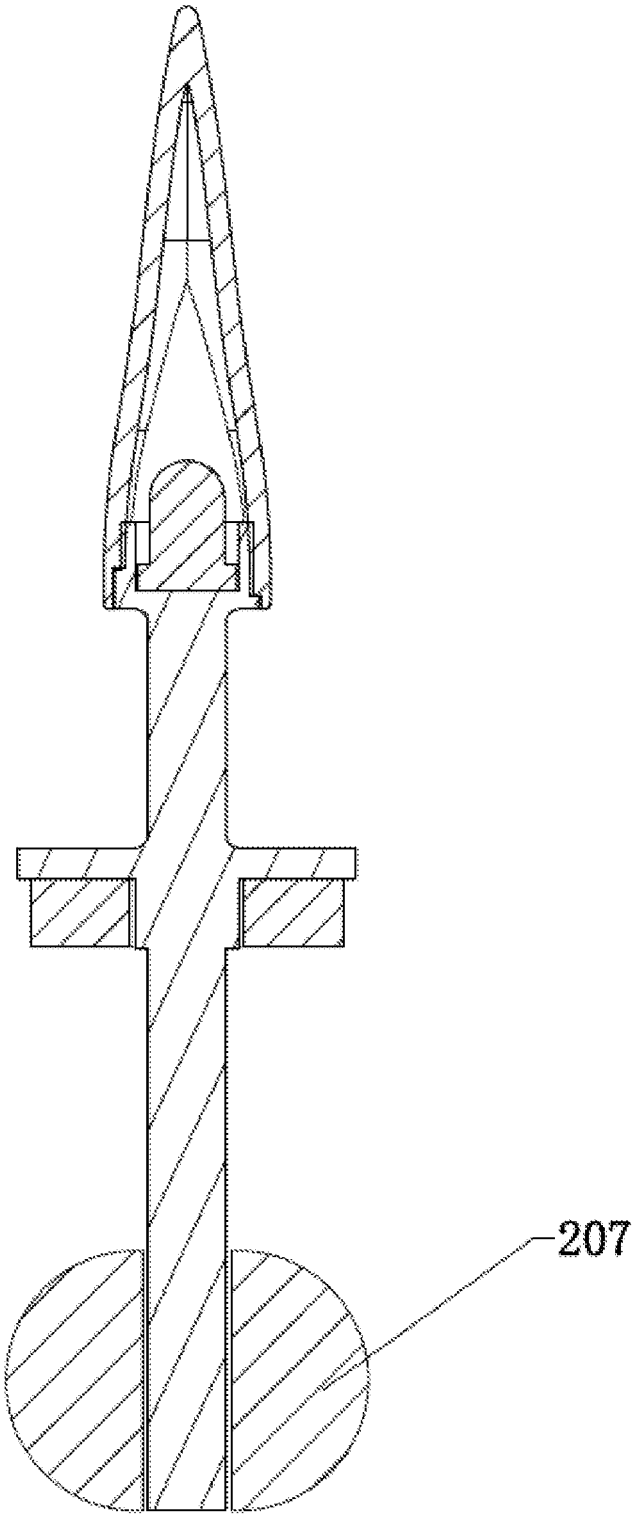
FIG. 10 is a schematic diagram illustrating a specific structure of a semicircular balancing weight according to Embodiment 2 of the disclosure.

As shown in FIG. 8 to FIG. 10, the balancing weight 207 has a trapezoidal, rectangular or semicircular cross section.

Embodiment 3

Figure 11:
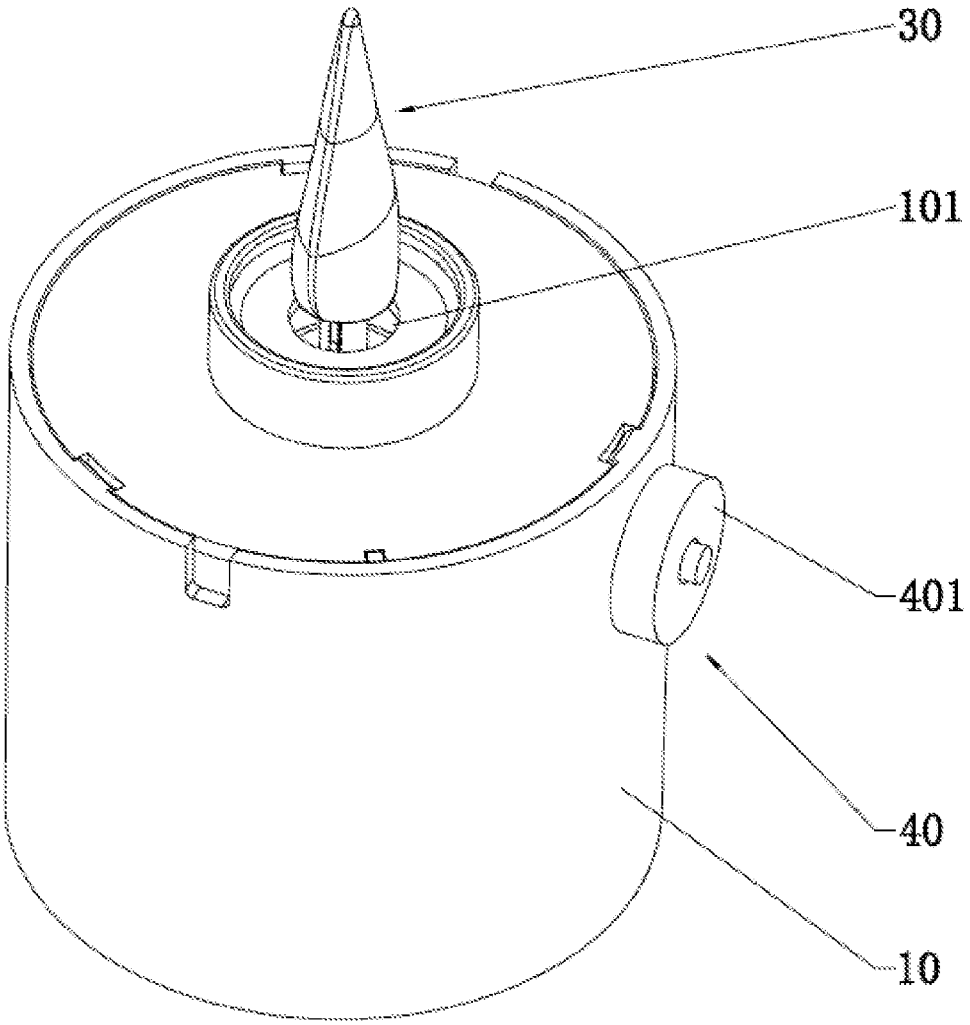
FIG. 11 is a specific structural diagram of a magnetic suspension support structure according to Embodiment 3 of the disclosure.
Figure 12:
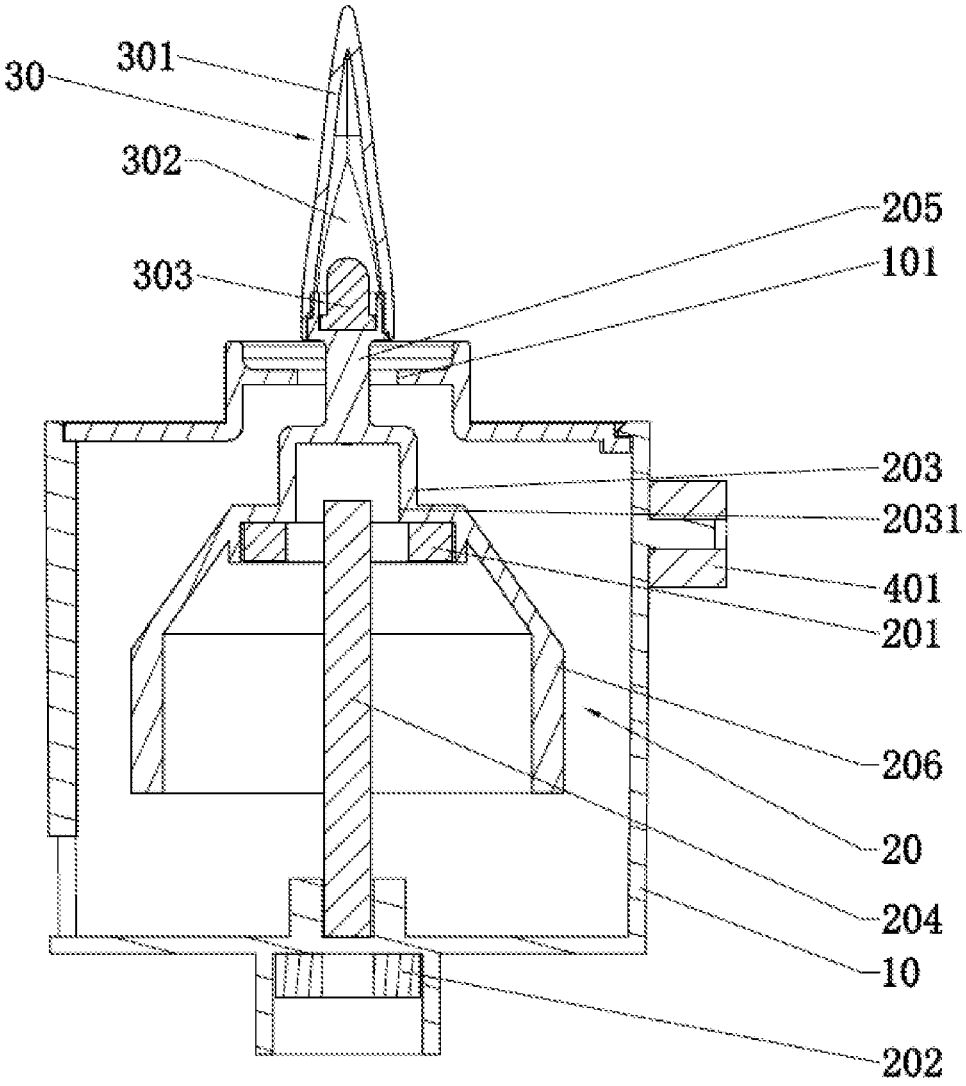
FIG. 12 is an internal structural diagram of a magnetic suspension support structure according to Embodiment 3 of the disclosure.
Figure 13:
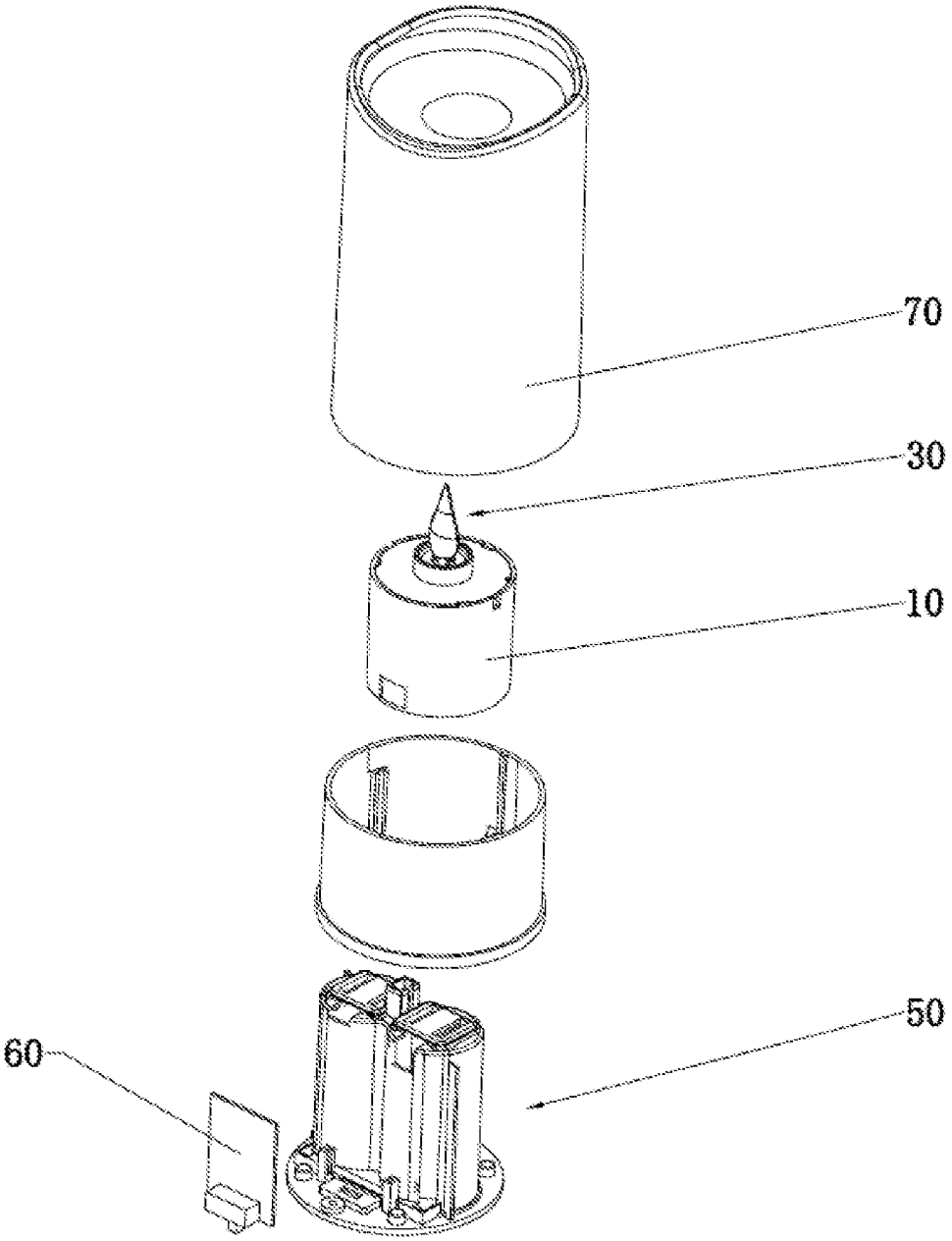
FIG. 13 is an exploded view illustrating an overall structure according to Embodiment 3 of the disclosure.

A magnetically suspended swinging electronic light-emitting device capable of simulating a realistic flame, referring to FIG. 11, FIG. 12 and FIG. 13, includes the magnetic suspension support structure as mentioned in the above embodiments, and further a light source module 30 which is fixedly mounted on the connecting pillar 205, and a driving assembly 40 that provides an external force to drive the suspension piece 203 to swing.

Preferably, the device further includes a power module 50 that supplies power to the light source module 30 and the driving assembly 40. The power module 50 is electrically connected to the light source module 30 and the driving assembly 40.

The device further includes a control module 60 for controlling a brightness of the light source module 30.

A power terminal of the control module 60 is electrically connected to the power module 50, and a control terminal of the control module 60 is electrically connected to the light source module 30 and the driving assembly 40.

In this embodiment, the power module 50 supplies power with a combination of a battery and a battery holder.

In this embodiment, the control module 60 is a microcontroller unit (MCU), also known as a single chip microcomputer or a single-chip computer, which is a computer on a chip that is formed by integrating peripheral interfaces such as memory, Timer, USB, A/D converter, UART, PLC and DMA and even a liquid crystal display (LCD) driver circuit on a single chip with appropriately reduced clock speeds and specifications of a central processing unit (CPU). The control module 60 may be set to achieve control on the light source module 30 and the driving assembly 40.

The light source module 30 includes a light cover in a flame shape having an outer flame cover body 301 and an inner flame cavity 302. A light source element 303 is secured in the inner flame cavity 302. The power module 50 may be electrically connected to the light source element 303 by means of a wire or in a contactless power-feeding manner, which, as being now commonly used, will not be described here in detail. The light source element 303 serves to simulate a flame core. The outer flame cover body 301 and the inner flame cavity 302 allow light rays emitted by the light source element 303 to shine therethrough to different extents, achieving the effect of simulate the inner and outer cones of a realistic flame and rendering the glowing effect of the device more realistic.

Preferably, the outer flame cover body 301 is cone-shaped or drop-shaped.

The device further includes a housing 70 disposed to cover the light source module 30, the magnetic suspension support structure and the power module 50 and serving to protect the components therein. Moreover, in this embodiment, the housing 70 is in a shape of a pillar candle. Designed in this way, the device not only has a glowing effect highly similar to that of a realistic flame, but also simulates a realistic candle in appearance, thus allowing for a further improvement on the overall ornamental effect of the device.

As an improvement to the above solution, the driving assembly 40 is a magnetic driving assembly 40.

The magnetic driving assembly 40 includes a coil 401 that is secured to the mounting base 10. In this embodiment, the coil 401 and the first permanent magnet 201 are located in the same horizontal plane.

The control terminal of the control module 60 is electrically connected to the coil 401.

With the control module 60, according to an equation H=(N*V/RL*Le)*D (where H represents a strength of a magnetic force, and N number of turns of the coil 401, V voltage, RL a resistance of the coil 401, Le an effective magnetic circuit length of the coil 401, and D power supply time of the coil 401 in unit time), a magnetic force affecting the first permanent magnet 201, namely a value of H, may be produced by regularly varying a value of D, causing the first permanent magnet 201 to tilt, swing or rotate due to the change of the magnetic force in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

As an improvement to the above solution, the driving assembly 40 is a wind power driving assembly 40.

The wind power driving assembly 40 includes fan blades and a motor for driving the fan blades to rotate. The motor is secured to the mounting base 10. The suspension piece 203 is located in an air-out direction of the fan blades.

The control terminal of the control module 60 is electrically connected to the motor.

With the control module 60 to start and stop the motor and thereby drive the fan blades to rotate, an external force may be provided for the suspension piece 203, causing the suspension piece 203 to tilt, swing or rotate due to the change of the force acting thereon in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

As an improvement to the above solution, the driving assembly 40 is a telescopic shaft driving assembly 40.

The telescopic shaft driving assembly 40 includes a telescopic shaft and a cylinder, the cylinder being secured to the mounting base 10. The suspension piece 203 is located in a moving travel of the telescopic shaft.

The control terminal of the control module 60 is electrically connected to the cylinder.

With the control module 60 to start and stop the cylinder and thereby drive the telescopic shaft to move telescopically, an external force may be provided by the telescopic shaft colliding with the suspension piece 203, causing the suspension piece 203 to tilt, swing or rotate due to the change of the force acting thereon in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

Embodiment 4

Figure 14:
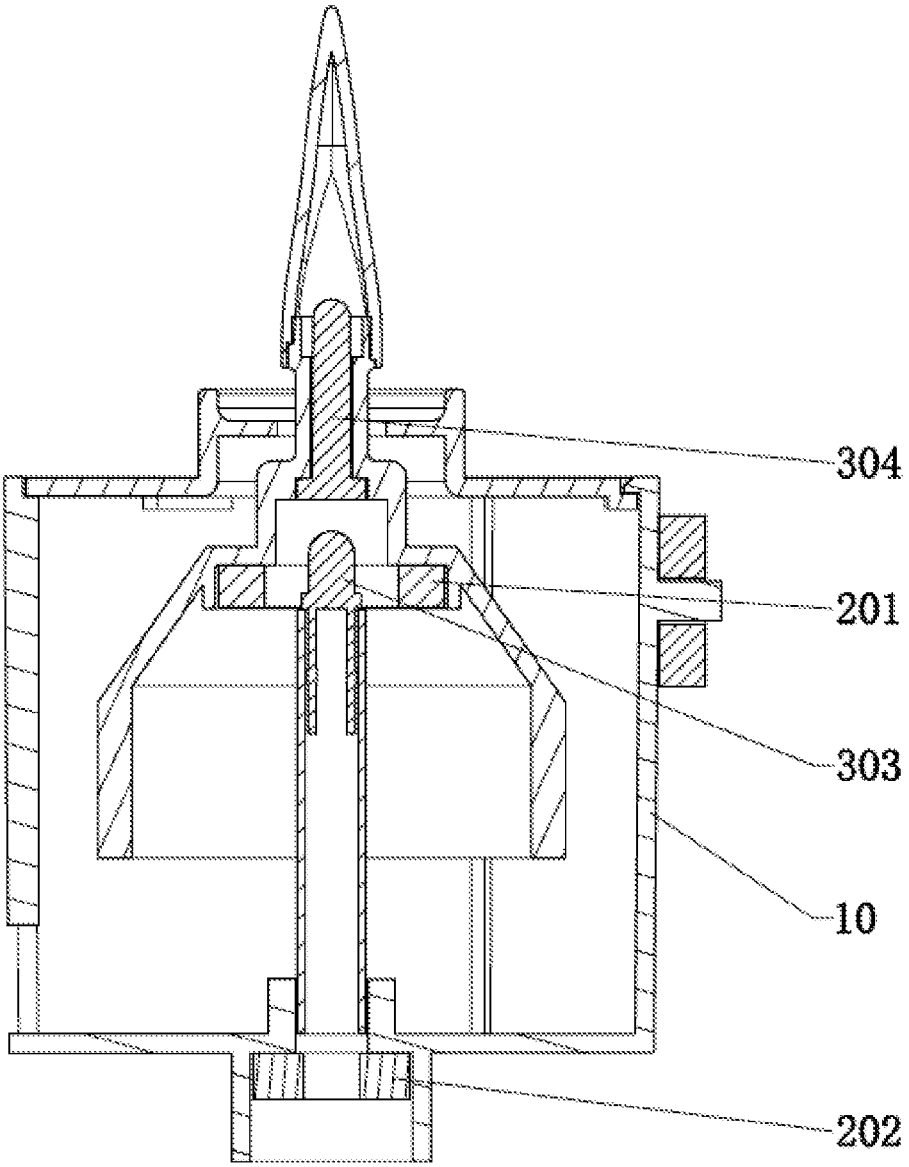
FIG. 14 is a diagram illustrating a specific structure according to Embodiment 4 of the disclosure.

A magnetically suspended swinging electronic light-emitting device capable of simulating a realistic flame, referring to FIG. 14, includes the magnetic suspension support structure as mentioned in the above embodiment 1, and further a light source module 30 which is fixedly mounted on the connecting pillar 205, and a driving assembly 40 that provides an external force to drive the suspension piece 203 to swing. In this embodiment, the second permanent magnet 202 is secured to the bottom of the mounting base 10.

In this embodiment, the light source module 30 includes a light source element 303, a light guide bar 304 and a flame-shaped light cover. The light source element 303 is secured to an end, extending into the positioning hole 2031, of the positioning piece 204. The light guide bar 304 extends through and is secured inside the connecting pillar 205 to be coaxial with the connecting pillar 205. The light cover is fixedly arranged at an end of the connecting pillar 205, and one end of the light guide bar 304 is located at the bottom of the light cover.

To show the swinging effect of the light source module 30, the light source module 30 can only be mounted on the suspension piece 203. The mounting of the light source element 303, however, may generally involve wiring arrangement, and there may be a problem of interference with the swinging of the suspension piece 203. Therefore, in this embodiment, the light source element 303 is mounted on the positioning piece 204 and light is guided to the light cover through the light guide bar 304, thereby solving the problem of interference of wiring and achieving an ideal swinging effect.

Preferably, the device further includes a power module 50 that supplies power to the light source element 303 and the driving assembly 40. The power module 50 is electrically connected to the light source element 303 and the driving assembly 40.

The device further includes a control module 60 for controlling a brightness of the light source element 303.

A power terminal of the control module 60 is electrically connected to the power module 50, and a control terminal of the control module 60 is electrically connected to the light source element 303 and the driving assembly 40.

In this embodiment, the power module 50 supplies power with a combination of a battery and a battery holder.

Preferably, the light cover includes an outer flame cover body 301 and an inner flame cavity 302. The outer flame cover body 301 and the inner flame cavity 302 allow light rays emitted by the light source element 303 to shine therethrough to different extents, achieving the effect of simulate the inner and outer cones of a realistic flame and rendering the glowing effect of the device more realistic.

Preferably, the outer flame cover body 301 is cone-shaped or drop-shaped. Preferably, the outer flame cover body 301 is flat drop-shaped.

The device further includes a housing 70 disposed to cover the light source module 30, the magnetic suspension support structure and the power module 50 and serving to protect the components therein. Moreover, in this embodiment, the housing 70 is in a shape of a pillar candle. Designed in this way, the device not only has a glowing effect highly similar to that of a realistic flame, but also simulates a realistic candle in appearance, thus allowing for a further improvement on the overall ornamental effect of the device.

As an improvement to the above solution, the driving assembly 40 is a magnetic driving assembly 40.

The magnetic driving assembly 40 includes a coil 401 that is secured to the mounting base 10. In this embodiment, the coil 401 and the first permanent magnet 201 are located in the same horizontal plane.

The control terminal of the control module 60 is electrically connected to the coil 401.

With the control module 60, according to an equation H=(N*V/RL*Le)*D (where H represents a strength of a magnetic force, and N number of turns of the coil 401, V voltage, RL a resistance of the coil 401, Le an effective magnetic circuit length of the coil 401, and D power supply time of the coil 401 in unit time), a magnetic force affecting the first permanent magnet 201, namely a value of H, may be changed by regularly varying a value of D, causing the first permanent magnet 201 to tilt, swing or rotate due to the change of the magnetic force in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

As an improvement to the above solution, the driving assembly 40 is a wind power driving assembly 40.

The wind power driving assembly 40 includes fan blades and a motor for driving the fan blades to rotate. The motor is secured to the mounting base 10. The suspension piece 203 is located in an air-out direction of the fan blades.

The control terminal of the control module 60 is electrically connected to the motor.

With the control module 60 to start and stop the motor and thereby drive the fan blades to rotate, an external force may be provided for the suspension piece 203, causing the suspension piece 203 to tilt, swing or rotate due to the change of the force acting thereon in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

As an improvement to the above solution, the driving assembly 40 is a telescopic shaft driving assembly 40.

The telescopic shaft driving assembly 40 includes a telescopic shaft and a cylinder, and the cylinder is secured to the mounting base 10. The suspension piece 203 is located in a moving travel of the telescopic shaft.

The control terminal of the control module 60 is electrically connected to the cylinder.

With the control module 60 to start and stop the cylinder and thereby drive the telescopic shaft to move telescopically, an external force may be provided by the telescopic shaft colliding with the suspension piece 203, causing the suspension piece 203 to tilt, swing or rotate due to the change of the force acting thereon in the horizontal direction and driving the suspension piece 203 in a magnetic suspension equilibrium state and finally the light source module 30 to swing. As a result, a gentle swinging effect based on the magnetic suspension support structure can be achieved, so that the swinging effect of the light source module 30 can be very close to the moving effect of a realistic flame.

The above descriptions are merely preferred implementations of the disclosure. It should be noted that a person of ordinary skill in the art may further make several improvements and modifications without departing from the principle of the disclosure, but such improvements and modifications should be deemed as falling within the protection scope of the disclosure.

The invention claimed is:

1. A magnetic suspension support structure, comprising a hollowed-out mounting base and a magnetic suspension assembly;

wherein the magnetic suspension assembly is located within the mounting base, and comprises a first permanent magnet, a second permanent magnet, a suspension piece for mounting a display object, and a positioning piece for restricting turn-over of the suspension piece;

the first permanent magnet is arranged on the suspension piece and located above the second permanent magnet; the second permanent magnet is arranged on the mounting base or the positioning piece; the first permanent magnet and the second permanent magnet repel each other to produce a support force on the suspension piece in a magnetic repelling direction; and one end of the suspension piece protrudes from the mounting base;

wherein the suspension piece comprises a connecting pillar allowing the display object to be mounted thereon; an auxiliary limiting hole allowing the connecting pillar to protrude from the mounting base is formed in the mounting base; and the auxiliary limiting hole serves to restrict turn-over of the connecting pillar;

wherein the positioning piece is in a rod shape and is vertically and fixedly arranged at a bottom of the mounting base; a positioning hole is formed in the suspension piece and has a larger cross-sectional area than the positioning piece; and when a weight of the suspension piece and the support force are balanced, one end of the positioning piece extends into the positioning hole to restrict turn-over of the suspension piece.

2. The magnetic suspension support structure according to claim 1, wherein the positioning hole comprises a limiting portion close to an opening of the positioning hole and a travel portion located within the positioning hole to allow upward and downward displacement of the suspension piece.

3. The magnetic suspension support structure according to claim 1, wherein the positioning piece is horizontally fixedly arranged on to an inner wall of the mounting base, the positioning piece is provided with a positioning hole and the suspension piece is in a rod shape and movably extends through the positioning hole.

4. A magnetically suspended swinging electronic light-emitting device capable of simulating a realistic flame, comprising the magnetic suspension support structure according to claim 2, and further comprising a light source module arranged on a suspension piece, and a driving assembly configured to provide an external force to drive the suspension piece to swing.

5. The magnetically suspended swinging electronic light-emitting device capable of simulating a realistic flame according to claim 4, further comprising a power module that is electrically connected to the light source module and the driving assembly.

6. The magnetically suspended swinging electronic light-emitting device capable of simulating a realistic flame according to claim 5, further comprising a control module for controlling a brightness of the light source module, wherein a power terminal of the control module is electrically connected to the power module; and a control terminal of the control module is electrically connected to the light source module and the driving assembly.

7. The magnetically suspended swinging electronic light-emitting device capable of simulating a realistic flame according to claim 6, wherein the driving assembly is a magnetic driving assembly;

the magnetic driving assembly comprises a coil arranged on the mounting base; and the control terminal of the control module is electrically connected to the coil.

8. The magnetically suspended swinging electronic light-emitting device capable of simulating a realistic flame according to claim 4, wherein the light source module comprises a light cover in a flame shape having an outer flame cover body and an inner flame cavity; and a light source element is arranged in the inner flame cavity.

9. A magnetically suspended swinging electronic light-emitting device capable of simulating a realistic flame, comprising the magnetic suspension support structure according to claim 3, and further comprising a light source module arranged on a suspension piece, and a driving assembly configured to provide an external force to drive the suspension piece to swing.

10. The magnetically suspended swinging electronic light-emitting device capable of simulating a realistic flame according to claim 9, further comprising a power module that is electrically connected to the light source module and the driving assembly.

11. The magnetically suspended swinging electronic light-emitting device capable of simulating a realistic flame according to claim 10, further comprising a control module for controlling a brightness of the light source module, wherein a power terminal of the control module is electrically connected to the power module; and a control terminal of the control module is electrically connected to the light source module and the driving assembly.

12. The magnetically suspended swinging electronic light-emitting device capable of simulating a realistic flame according to claim 11, wherein the driving assembly is a magnetic driving assembly;

the magnetic driving assembly comprises a coil arranged on the mounting base; and the control terminal of the control module is electrically connected to the coil.

13. The magnetically suspended swinging electronic light-emitting device capable of simulating a realistic flame according to claim 9, wherein the light source module comprises a light cover in a flame shape having an outer flame cover body and an inner flame cavity; and a light source element is arranged in the inner flame cavity.

14. A magnetically suspended swinging electronic light-emitting guide device capable of simulating a realistic flame, comprising the magnetic suspension support structure according to claim 2, and further comprising a light source module arranged on the suspension piece, and a driving assembly configured to provide an external force to drive the suspension piece to swing;

wherein the light source module comprises a light guide bar and a flame-shaped light cover;

a light source element is arranged at an end, extending into the positioning hole, of the positioning piece;

the light guide bar extends through and is fixedly arranged inside the connecting pillar to be coaxial with the connecting pillar;

the light cover is arranged at an end of the connecting pillar, and one end of the light guide bar is located at a bottom of the light cover.

15. The magnetically suspended swinging electronic light-emitting guide device capable of simulating a realistic flame according to claim 14, further comprising a power module that is electrically connected to the light source module and the driving assembly.

16. The magnetically suspended swinging electronic light-emitting guide device capable of simulating a realistic flame according to claim 15, further comprising a control module for controlling a brightness of the light source module, wherein a power terminal of the control module is electrically connected to the power module; and a control terminal of the control module is electrically connected to the light source module and the driving assembly.

17. The magnetically suspended swinging electronic light-emitting guide device capable of simulating a realistic flame according to claim 14, wherein the light cover comprises an outer flame cover body and an inner flame cavity; and one end of the light guide bar is located in the inner flame cavity.

18. A magnetically suspended swinging electronic light-emitting guide device capable of simulating a realistic flame, comprising the magnetic suspension support structure according to claim 3, and further comprising a light source module arranged on the suspension piece, and a driving assembly configured to provide an external force to drive the suspension piece to swing;

wherein the light source module comprises a light guide bar and a flame-shaped light cover;

a light source element is arranged at an end, extending into the positioning hole, of the positioning piece;

the light guide bar extends through and is fixedly arranged inside the connecting pillar to be coaxial with the connecting pillar;

the light cover is arranged at an end of the connecting pillar, and one end of the light guide bar is located at a bottom of the light cover.

19. The magnetically suspended swinging electronic light-emitting guide device capable of simulating a realistic flame according to claim 18, further comprising a power module that is electrically connected to the light source module and the driving assembly.

20. The magnetically suspended swinging electronic light-emitting guide device capable of simulating a realistic flame according to claim 19, further comprising a control module for controlling a brightness of the light source module, wherein a power terminal of the control module is electrically connected to the power module; and a control terminal of the control module is electrically connected to the light source module and the driving assembly.

21. The magnetically suspended swinging electronic light-emitting guide device capable of simulating a realistic flame according to claim 18, wherein the light cover comprises an outer flame cover body and an inner flame cavity; and one end of the light guide bar is located in the inner flame cavity.

* * * * *